US008492999B2

(12) United States Patent
Cheng

(10) Patent No.: US 8,492,999 B2
(45) Date of Patent: Jul. 23, 2013

(54) SYSTEM AND METHOD FOR CONTROLLING ELECTRICAL POWER OF LED AND LED PROJECTOR HAVING THE SAME

(75) Inventor: Wen-Chin Cheng, Hsinchu County (TW)

(73) Assignee: Lumens Digital Optics Inc., Jhubei, Hsinchu County (TW)

( * ) Notice: Subject to any disclaimer, the term of this patent is extended or adjusted under 35 U.S.C. 154(b) by 516 days.

(21) Appl. No.: 12/725,690

(22) Filed: Mar. 17, 2010

(65) Prior Publication Data

US 2011/0074314 A1 Mar. 31, 2011

(30) Foreign Application Priority Data

Sep. 30, 2009 (TW) ..... 98133286 A

(51) Int. Cl.
*G05F 1/00* (2006.01)

(52) U.S. Cl.
USPC ..... 315/307; 315/297; 315/291; 315/224; 315/169.1; 345/102; 353/85

(58) Field of Classification Search
USPC ..... 315/169.1, 169.3, 247, 291, 224, 315/297, 307, 312; 362/227, 612, 800; 353/85; 345/77, 82, 102
See application file for complete search history.

(56) References Cited

U.S. PATENT DOCUMENTS

| | | | | |
|---|---|---|---|---|
| 6,570,505 | B1 | 5/2003 | Malenfant | |
| 6,623,126 | B2 * | 9/2003 | Sekiguchi et al. | 353/62 |
| 7,038,594 | B2 * | 5/2006 | Voreis et al. | 340/815.45 |
| 7,252,385 | B2 * | 8/2007 | Engle et al. | 353/52 |
| 7,324,130 | B2 * | 1/2008 | Russell et al. | 347/237 |
| 7,646,029 | B2 * | 1/2010 | Mueller et al. | 257/84 |
| 7,759,881 | B1 * | 7/2010 | Melanson | 315/307 |
| 7,777,702 | B2 * | 8/2010 | Reuter | 345/82 |
| 7,834,824 | B2 * | 11/2010 | Routley et al. | 345/77 |
| 8,184,670 | B2 * | 5/2012 | Crawford et al. | 372/38.02 |
| 2006/0290625 | A1 | 12/2006 | Sugimoto | |
| 2008/0012997 | A1 | 1/2008 | Reuter | |
| 2008/0303456 | A1 | 12/2008 | Sun et al. | |

FOREIGN PATENT DOCUMENTS

| | | |
|---|---|---|
| CN | 1988745 | 6/2007 |
| CN | 101188720 | 5/2008 |
| CN | 101256292 | 9/2008 |

OTHER PUBLICATIONS

Chinese Office Action, Application No. 200910209472.7, issued Jan. 7, 2013.

* cited by examiner

*Primary Examiner* — Haiss Philogene
(74) *Attorney, Agent, or Firm* — Volpe and Koenig, P.C.

(57) ABSTRACT

A method for controlling electrical power of light emission diodes (LED) is provided. The above method comprises steps of providing a supply voltage to the LED driver; providing a driving current to the LED by the LED driver; obtaining an operating voltage of the LED; and adjusting the supply voltage according to the operating voltage of the LED.

17 Claims, 5 Drawing Sheets

SYSTEM AND METHOD FOR CONTROLLING ELECTRICAL POWER OF LED AND LED PROJECTOR HAVING THE SAME

FIELD OF THE INVENTION

The present invention relates to a system and a method for controlling electrical power of light emission diodes (LEDs), especially to a system and a method for controlling electrical power of LEDs as a light source of an LED projector.

BACKGROUND OF THE INVENTION

Please refer to FIG. 1, which is the schematic diagram showing a conventional projector with the light source of LEDs. The power of the conventional projector with the LED light source normally comes from the household power supply, such as the alternating current (AC) from the electric outlet on the wall, where the AC is rectified and transformed by the power supply 2 so that the electrical power can be used by the components inside the projector. Only the issues of the power supply for LED are discussed here. That is, only the issues regarding the power transmission from the power supply 2 to the driver 3 are discussed, and the other parts will not be considered. The power supply 2 usually has the function of transforming the voltage, usually reducing the voltage, and sometimes the function of rectifying or stabilizing the voltage. The AC from the outlet on the wall is outputted to the power supply 2. After the conversion and transformation, the power supply 2 output a supply voltage v1 to the drive 3. The drive 3 is responsible for driving the LED 4, and outputs a drive current A to the LED 4. Accordingly, the light source of the projector can operate properly.

However, some deviations occur during the manufacture of LEDs, so the operating voltage for each LED is not identical, but is somewhat higher or lower. Therefore, in order to cover the whole operating voltage from the lowest to the highest operating voltages, the power supply 2 outputs a higher supply voltage v1 than the average required voltage to the driver 3 in the conventional technique. Usually, the supply voltage v1 is possibly higher than the acceptable voltage by the LED by about one third of the acceptable voltage. Therefore, when the driver 3 generates the constant current, and outputs the driving current A to the LED 4, there will be an operating voltage v2 for the LED 4, and the difference between the operating voltage v2 and the supply voltage 1 exists. At this moment, the driver 3 absorbs the energy of this voltage difference and generates the heat for this over voltage. The negative effects are the generation of high heat and the electricity wastage.

For solving the above mentioned problems, the inventors had done a lot of efforts in the analyses, researches and developments, and finally developed the system and the method for controlling the power of LEDs.

SUMMARY OF THE INVENTION

The present invention provides the system and the method for controlling the power for the LED, which can be used as a light source of the LED projector. The system and the method of the present invention can lower the heat generation, decrease the requirements of the heat dissipation, and reduce the whole electricity consumption in the projector.

In accordance with one aspect of the present invention, a method for controlling an electric power of a light emission diode (LED) driven by an LED driver is provided.

The above method comprises steps of providing a supply voltage to the LED driver; providing a driving current to the LED by the LED driver; obtaining an operating voltage of the LED; and adjusting the supply voltage according to the operating voltage of the LED.

In the above method, wherein the supply voltage is provided by a power supply electrically connected to the LED driver.

In the above method, wherein the step of adjusting the supply voltage is performed to control the power supply by using a processor electrically connected to the power supply and the LED driver.

The above method further comprises a step of sending a control signal to the power supply by the processor to decrease the supply voltage, when the supply voltage provided by the power supply to the LED driver is higher than a sum of the operating voltage of the LED and a voltage drop for operating the LED driver.

In the above method, wherein the LED is a light source of a projector.

In the above method, wherein the projector includes the LED, the LED driver, the power supply and the processor.

The above method further comprises a step of receiving a driving signal from the LED driver by a processor, wherein the driving signal includes information of the operating voltage of the LED in the projector.

In accordance with another aspect of the present invention, an LED projector is provided.

The above LED projector comprises an LED; a power supply providing a supply voltage; an LED driver electrically connected to the power supply and the LED, receiving the supply voltage, and outputting a driving current to the LED; and a processor electrically connected to the power supply and the LED driver, and controlling the power supply to adjust the supply voltage.

In the above LED projector, wherein the processor obtains a driving signal from the LED driver, wherein the driving signal includes information of an operating voltage of the LED.

In the above LED projector, wherein the processor sends a control signal to the power supply to decrease the supply voltage when the supply voltage provided by the power supply to the LED driver is higher than a sum of the operating voltage of the LED and a voltage drop for operating the LED driver.

In the above LED projector, wherein the power supply further comprises a rectifier transforming an alternating current to a direct current; a power-factor corrector correcting a power factor of the alternating current; a DC voltage converter adjusting a voltage from the power-factor corrector to an optimum voltage for the LED driver, wherein the optimum voltage is a sum of the operating voltage of the LED and a voltage drop for operating the LED driver; and a digital-to-analog converter electrically connected to the DC voltage converter and the processor, converting a control signal sent by the processor to a control voltage, and sending the control voltage to the DC voltage converter to adjust the supply voltage.

In the above LED projector, wherein the LED driver further comprises a voltage-to-current converter electrically connected to the power supply, and converting the supply voltage to the driving current; and a driving control circuit electrically connected to the processor and the voltage-to-current converter, obtaining the operating voltage of the LED, sending the driving signal to the processor, and managing the driving current to LED by getting a command from the processor.

In accordance with a further aspect of the present invention, a system for controlling an electric power of a light emission diode (LED) is provided.

The above system comprises a supply voltage; a processor sending a command, and adjusting the supply voltage; and an LED driver electrically connected to the processor, and outputting a driving current to the LED in response to the command.

The above system further comprises a power supply providing the supply voltage, wherein the LED driver is electrically connected to the power supply and receives the supply voltage; the processor is electrically connected to the power supply, obtains a driving signal from the LED driver and controls the power supply to adjust the supply voltage; and the LED is a light source of a projector including the system and the LED.

In the above system, wherein the driving signal includes information of an operating voltage of the LED.

In the above system, wherein the LED driver further comprises a voltage-to-current converter electrically connected to the power supply, and converting the supply voltage to the driving current; and a driving control circuit electrically connected to the processor and the voltage-to-current converter, obtaining the operating voltage of an LED, sending the driving signal to the processor, and managing the driving current to LED by getting a command from the processor.

The above system further comprises a power supply providing the supply voltage and electrically connected to the LED driver and the processor, wherein the processor sends a control signal to the power supply for controlling the power supply to adjust the supply voltage.

In the above system, wherein the control signal includes information of a required adjustment to the supply voltage provided by the power supply.

In the above system, wherein the power supply further comprises a rectifier transforming an alternating current to a direct current; and a power-factor corrector correcting a power factor of the alternating current.

In the above system, wherein the power supply further comprises a DC voltage converter adjusting a voltage from the power-factor corrector to an optimum voltage for the LED driver, wherein the optimum voltage is a sum of the operating voltage of the LED and a voltage drop for operating the LED driver; and a digital-to-analog converter electrically connected to the DC voltage converter, converting the control signal to a control voltage, and sending the control voltage to the DC voltage converter to adjust the supply voltage.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
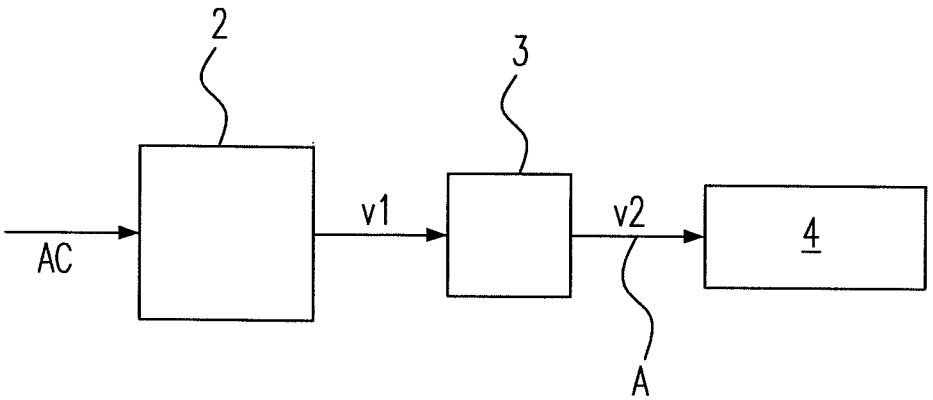
Fig. 1 (Prior Art)
FIG. 1 is the schematic diagram showing a conventional projector with an LED light source.
Figure 2:
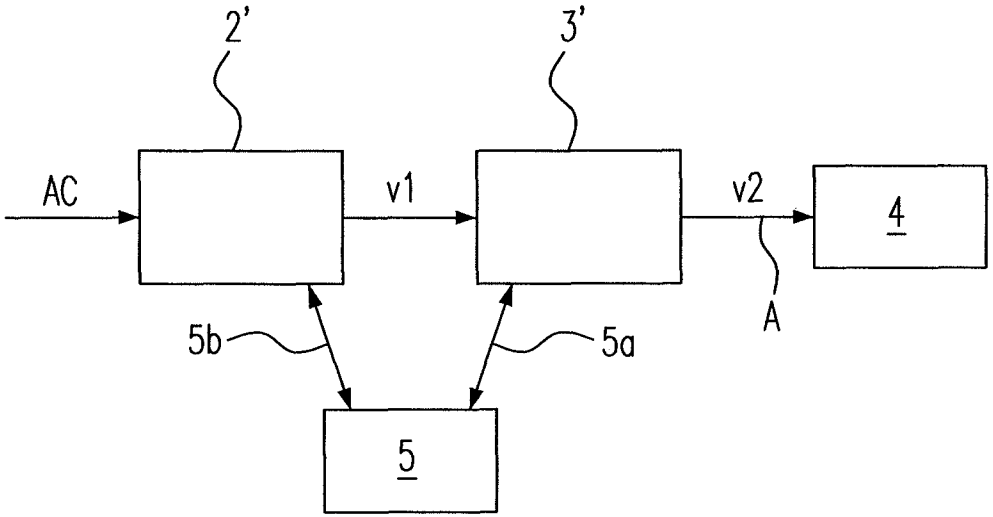
FIG. 2 is the schematic diagram showing a control system of a projector of the present invention.

Please refer to FIG. 2, which is the schematic diagram showing a control system of a projector of the present invention. In the basic configuration, the external electric power source, usually a household (or indoor or wall) electric power source, provides electricity to a power supply, and then the electricity after the appropriate transactions, usually the voltage transformation and rectification, is transmitted to an LED driver and finally transmitted to the LED. In the present invention, the system includes a processor 5 to control the power of the light source, e.g. LED. A switchable power supply 2' is specially adopted in the present system. The external power source provides a alternating current (AC) to power supply 2', which can adjust its output voltage and output a supply voltage v1 to the LED driver 3'. The LED driver 3' is an information electronic apparatus, and can output the signals to inform the other electronic elements of its own operating status. The controlling system of the present invention includes the LED driver 3', which has the function of sending signals, converts the supply voltage v1 from the power supply 2' to a constant electric current and then outputs a driving current A to drive the LED 4 for illuminating. Thus, there is an operating voltage v2 generated between the LED 4 and the LED driver 3'. On the other hand, the LED driver 3' is electrically connected to the processor 5, which can receives the driving signal 5*a* from the LED driver 3'. Then the processor 5 can figure out how much voltage reduction was performed by the LED driver 3' for providing the power to the LED 4. One of the purposes of the present invention is aimed at solving the problem of the power consumption of the projector with the LED light source. The power consumption of the conventional driver results from too high supply voltage v1 so that there exist an extra voltage besides the operating voltage 2 for illuminating the LED 4 and the power consumption for operating the driver 3'. However, the LED 4 needs a constant current, thus the driver 3' has to use the electric resister to adjust the voltage so as to provide the constant current, and consequently considerable amount of heat is generated. This heat can significantly shorten the lifetime of the electronic elements. In order to eliminate the damage from the high heat, the heat dissipation for the driver becomes necessary in the projector. On the contrary, the intellectual LED driver 3' in the present invention can inform the processor 5 whether the supply voltage v1 is too high or not. If too high, the processor 5 will send a control signal 5*b* to allow the power supply 2' to reduce the supply voltage v1.

From the above, in the present invention, it becomes possible to control the supply voltage v1 from the power supply 2' by adopting the processor 5, which is electrically connected to the driver 3' and power supply 2'. Therefore, the supply voltage v1 outputted from the power supply 2' after the adjustment of the present invention is approximately equal to the sum of the internally required voltage for the driver 3' and the operating voltage v2. Accordingly, the heat generated by the driver 3' is only the heat spontaneously resulted from operating itself, and there is no heat resulted from the too high supply voltage v1. Thus, another purpose of reducing the heat of the projector by solving the power consumption problem can be successfully reached in the present invention. More-over, since the heat problem does not disturb the driver of the projector, and requirements for the heat dissipation can be significantly reduced. Consequently, the energy consumption for the heat dissipation can be reduced. For example, the fan for the heat dissipation may not be required any more, or at least the design of the heat dissipation elements for cooling the driver can be much simplified. Anyway, the present invention reduces not only the power consumption but also the requirements of the heat dissipation. The adoption of the heat dissipation elements with the lower cost due to the lower requirements of the heat dissipation can further decrease the total cost of the projector. For the end-users, the reduction of the utility fee can be a great advantage.

Figure 3:
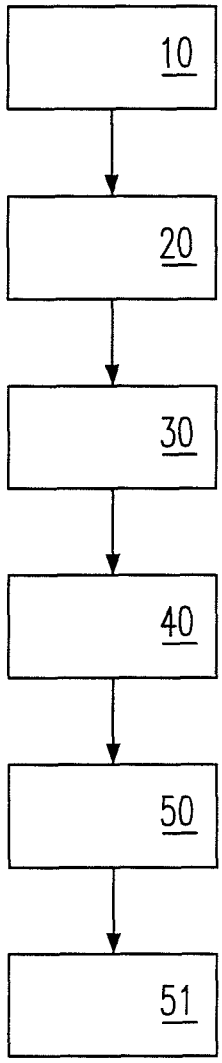
FIG. 3 is the schematic diagram showing a flowchart of a control method of the present invention.

Please refer to FIG. 3, which is the schematic diagram showing a flowchart of a control method of the present invention. The steps are described as follows. At first, the electric power source 10 is provided. Usually, this power source 10 comes from the household power source with the voltage of 110 or 220 Volt. Next, a power supply 20 is provided to transform and rectify the voltage of the power source so the LED driver can properly work. Then the LED driver 30 with the function of driving the LED is provided. In the following step, the LED 40 is provided. At this step, the electric current is provided to the LED 40, so the LED 40 can illuminate. There spontaneously exists a voltage applied to the LED 40 after the current flows therein, and this voltage is the operating voltage v2, as referring to FIG. 2 as well. Next, the required voltage 50 of the LED 40 is obtained. In the following step, the voltage 51 outputted to the LED 40 is adjusted. The LED driver 40 is driven by the driver 30, which power comes from the power supply 20, so the above step of adjusting the voltage 51 outputted to the LED 40 is actually performed by adjusting the output power of the power supply 20. That is, the supply voltage v1 in FIG. 2 is adjusted. The adjustment to the supply voltage v1 from the power supply is made by operating a controller 5 as referring to FIG. 2. The controller 5 determines whether the supply voltage v1 should be adjusted based on the information of voltage outputted by the driver to the LED.

FIG. 3 shows a detailed flowchart. The method for controlling the power of the LED light source of the projector actually can be presented in the following three steps: first, outputting a driving voltage to an LED; obtaining a required voltage of the LED; and adjusting the driving voltage outputted to the LED.

Furthermore, in the above step of outputting a driving voltage to an LED, a driving voltage is outputted by an LED driver to an LED. There exist a voltage difference between the LED driver and the LED called operating voltage. The power source of the LED driver comes from a power supply. In the above step of obtaining a required voltage of the LED, a processor obtains a required voltage of the LED. The direct power source of the LED is the LED driver. Thus, the processor obtains the information of the required voltage of the LED from the LED driver. In other word, the LED transmits the information to the processor via the LED driver. In the above step of adjusting the driving voltage outputted to the LED, the driving voltage outputted to the LED is adjusted. Since the power source of the LED driver comes from the supply voltage provided by a power supply, the adjustment of the driving voltage is actually done by adjusting the supply voltage. The way of the adjustment is performed by sending the signal by the processor to the power supply to allow the power supply to reduce its supply voltage. If the supply voltage is too high, so the voltage reduction for the driving voltage transformed by the LED driver is too much, then the supply voltage will be lowered by the adjustment.

In the present invention, the power supply usually provides a higher voltage than the required voltage of the LED by an extent of one-fifth, one-quarter or one-third of the required voltage. The LED driver includes a voltage-current converter. If the supply voltage from the power supply is too high, when the driver converts the voltage to the current, the driver has to lower the high voltage so that the outputted current from the driver to the LED is the maximum acceptable current by the LED. That is, the LED is operating in full power. In this condition, the processor can obtains the operating voltage of the LED via the LED driver, and then sends a control signal to the power supply so as to reduce the supply voltage of the power supply. In other words, the difference between the supply voltage and the operating voltage is alleviated to reduce the burden of the LED driver. Theoretically, the supply voltage is reduced to that equal to the operating voltage of the LED. However, actually the electric power must pass the LED driver, and some voltage reduction inevitably occurs there. Therefore, the supply voltage is somewhat higher than the required voltage of the LED.

Figure 4:
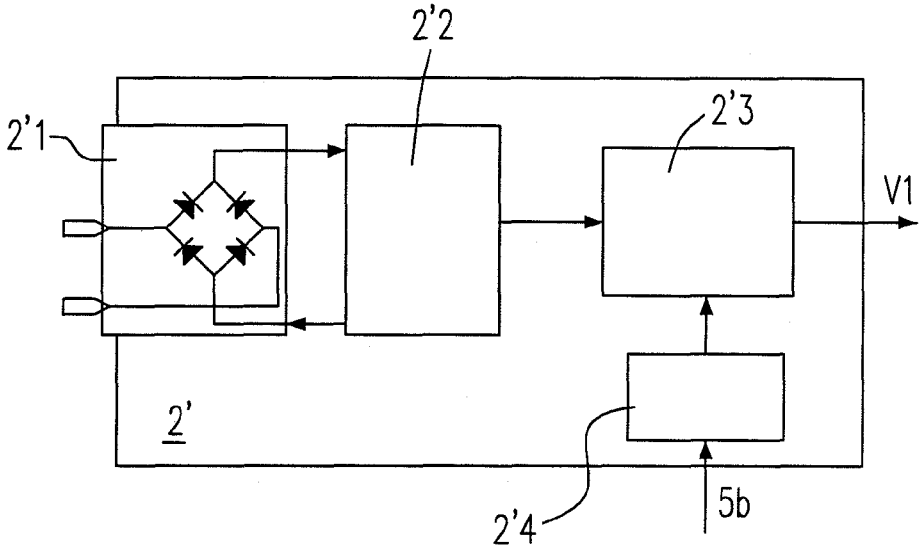
FIG. 4 is the schematic diagram showing the electronic circuit blocks of the switchable power supply of the present invention.

Please refer to FIG. 4, which is the schematic diagram showing the electronic circuit blocks of the switchable power supply of the present invention. The switchable power supply 2' includes a rectifier (or rectifying circuit) 2'1, which receives an alternating current (AC) from an external power source, converts this AC to a supply voltage v1, and outputs the supply voltage v1 to the LED driver 3', as referring to FIG. 5. The power supply 2' further includes a power-factor corrector 2'2 for correcting the power factor of the AC from the rectifier 2'1. In FIG. 4, the power supply 2' further includes a DC voltage converter (or DC voltage converting circuit) 2'3, which transforms the voltage from the power factor corrector 2'2 down to the voltage acceptable by the LED driver 3'. In addition, the power supply 2' further includes a digital-analog converter 2'4, which is electrically connected to the DC voltage converter 2'3, converts the control signal 5*b* generated by the processor 5 to a control voltage Vctrl, and then sends the Vctrl to the DC voltage converter 2'3 so that the DC voltage converter 2'3 can adjust its outputted supply voltage v1 according to the control signal 5*b*.

Figure 5:
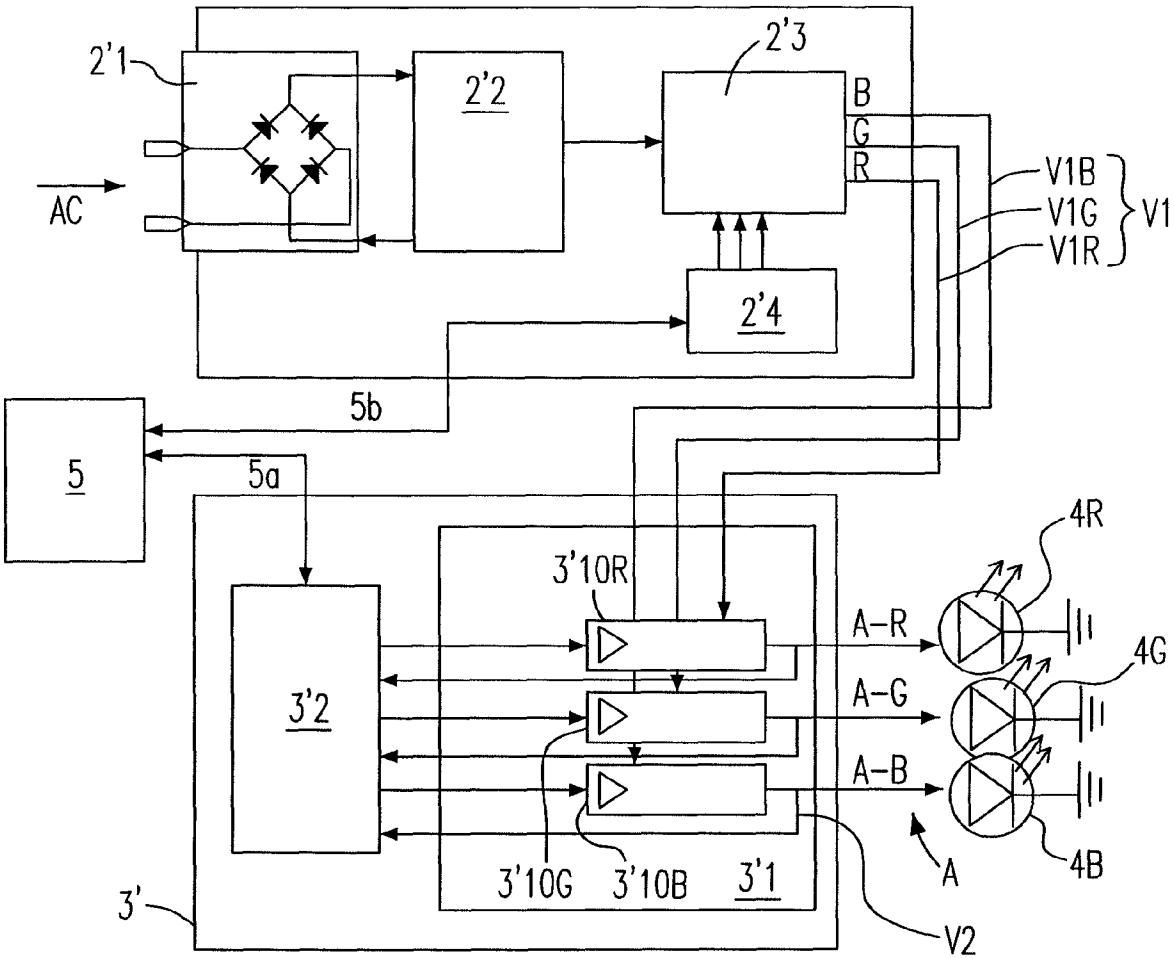
FIG. 5 is the schematic diagram showing the electronic circuit blocks of the light source power control system of the present invention.

Please refer to FIG. 5, which is the schematic diagram showing the electronic circuit blocks of the light source power control system of the present invention. The illustrations regarding the processor 5 and the switchable power supply 2' have been described in the above paragraphs and are not repeated, and only the LED driver 3' is described here. In FIG. 5, the LED driver 3' includes a power loop 3'1, which is usually an analog power stage. Through the build-up of this loop, the required voltage of each LED can be turned into sendable information. Through a driver control circuit 3'2, usually a driver logic, the driving signal 5*a* with the information of the operating voltage of the LED can be sent to the processor 5.

Please continue to refer to FIG. 5. The power loop 3'1 can include at least one voltage-to-current converter, e.g. 3'10R, 3'10G and 3'10B, which are electrically connected to the power supply 2' and converts the supply voltage v1 to the driving current A so that the LEDs, 4R, 4G and 4B, can be operating in full power without being damaged. Besides, most high-level projectors adopt three-primary-color, i.e. red, green and blue, processing. Thus, the LEDs in this embodiment are illustrated as LEDs 4R, 4G and 4B. Accordingly, the supply voltage v1 can be divided into the first supply voltage v1R, the second supply voltage v1G and the third supply voltage v1B, which are sent to the first voltage-to-current converter 3'10R, the second voltage-to-current converter 3'10G and the third voltage-to-current converter 3'10B, respectively. Through the conversion function of each voltage-to-current converter, the first driving current A-R, the second driving current A-G and the third driving current A-B are generated, respectively, and then outputted to the LEDs 4R, 4G and 4B, respectively. The operating voltage v2 can be obtained between each LED and each voltage-to-current converter.

Please continue to refer to FIG. 5. The power loop 3'1 includes three voltage-to-current converters, 3'10R, 3'10G and 3'10B, each of which can communicate the signals to the driver controlling circuit 3'2 so that the driver controlling circuit 3'2 can obtain the operating voltage v2 converted from the voltage from the power supply 2' by each voltage-to-current converter. Then the driver controlling circuit 3'2 sends a driving signal 5*a* to the processor 5 so that the processor 5 can obtain a voltage adjustment value for the difference between the supply voltage v1 and the operating voltage v2, and determine whether the first supply voltage v1R, the second supply voltage v1G and the third supply voltage v1B are too high or not. After then, the processor 5 sends the control signal 5*b* to the digital-to-analog converter 2'4, which generates a control voltage Vctrl to adjust the first supply voltage v1R, the second supply voltage v1G and the third supply voltage v1B outputted from the DC voltage converter 2'3. The processor 5 can be connected to the driver controlling circuit 3'2 and the digital-to-analog converter 2'4 via the IIC or SPI interface.

Please refer to FIG. 5. In the present invention, when the projector is switched on, the switchable power supply 2' provides a higher voltage to the LED driver 3' than the required voltage of the each LED, 4R, 4G ad 4B, by an extent of one-fifth, one-quarter or one-third of the required voltage. That is, the first supply voltage v1R, the second supply voltage v1G and the third supply voltage v1B are higher than required voltages of the respective LEDs by a specific extent. For instance, if the required voltage of the LED is 4.5 volt, the driving voltage up to 6 volt may be provided. In order to provide the constant currents, i.e. the first driving current A-R, the second driving current A-G and the third driving current A-B, to the LEDs, the each DC voltage converter, i.e. 3'10R, 3'10G and 3'10B, of the LED driver 3' has to lower the higher driving voltage. The voltage after the lowering is the operating voltage v2 between the LEDs, 4R, 4G and 4B, and the respective DC voltage converters. That is, at this moment, the LED driver 3' absorbs the reduced voltage between the respective driving voltage and the operating voltage by generating a considerable amount of heat so as to provide the constant currents to the LEDs. At the same time, the driver controlling circuit 3'2 can inform the voltage reduction quantity to the processor 5 via the driving signal 5*a* so that the processor 5 can determine whether the respective supply voltages are too high or not. If too high, the processor 5 sends the control signal 5*b* to the digital-to-analog converter 2'4, which generates a control voltage Vctrl sent to the DC voltage converter 2'3 to lower the supply voltage to an optimum value. Theoretically, the supply voltage is reduced to that equal to the operating voltage of the LED. However, actually the electric power must pass the LED driver, and some voltage reduction inevitably occurs there. Therefore, the supply voltage is somewhat higher than the required voltage of the LED; otherwise the supply voltage after passing the LED driver will be less than the required operating voltage v2 due to the power consumption of the LED driver. From the above description, by applying the systems and methods of the present invention, the driver 3' does not need to largely reduce the supply voltage v1 from the power supply 2', so the power consumption in the driver 3' can be largely reduced, and accordingly the heat generated by the driver 3' due to the energy of the voltage reduction can be largely reduced.

To sum up, in the systems and methods for controlling the electric power of the LED light source for the projector in the present invention, a processor is adopted to determine whether the voltage outputted by the LED driver is too high or not. If the voltage is too high, the processor will lower the voltage outputted to the LED driver. Thus, the problem of heat generated by the LED driver due to too high supply voltage can be eliminated. Not only can the power consumption be significantly reduced, but also the possible damages to the relevant electronic elements due to high heat can be avoided. When the heat is largely decreased, the power consumption of the projectors can be significantly lowered, and the requirements of the heat dissipation for the LED driver can be lowered as well. Consequently, the configuration design of the projector can be simplified, and the relevant cost can be advantageously reduced. From the above, the reductions of the power consumption and the cost will be great benefits contributed to both the manufacturers and the users.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A method for controlling an electric power of a light emission diode (LED) driven by an LED driver, comprising steps of:

providing a supply voltage to the LED driver by a power supply;

providing a driving current to the LED by the LED driver;

obtaining an operating voltage of the LED;

controlling the power supply to adjust the supply voltage according to the operating voltage of the LED by using a processor; and sending a control signal to the power supply by the processor to decrease the supply voltage, when the supply voltage provided by the power supply to the LED driver is higher than a sum of the operating voltage of the LED and a voltage drop for operating the LED driver.

2. The method of claim 1, wherein the power supply is electrically connected to the LED driver.

3. The method of claim 2, wherein the processor is electrically connected to the power supply and the LED driver.

4. The method of claim 1, wherein the LED is a light source of a projector.

5. The method of claim 4, further comprising a step of receiving a driving signal from the LED driver by the processor, wherein the driving signal includes information of the operating voltage of the LED in the projector.

6. The method of claim 4, wherein the projector includes the LED, the LED driver, the power supply and the processor.

7. An LED projector, comprising:

an LED;

a power supply providing a supply voltage;

an LED driver electrically connected to the power supply and the LED, receiving the supply voltage, and outputting a driving current to the LED; and a processor electrically connected to the power supply and the LED driver, and controlling the power supply to adjust the supply voltage, wherein the processor sends a control signal to the power supply to decrease the supply voltage when the supply voltage provided by the power supply to the LED driver is higher than a sum of an operating voltage of the LED and a voltage drop for operating the LED driver.

8. The projector of claim 7, wherein the processor obtains a driving signal from the LED driver, wherein the driving signal includes information of the operating voltage of the LED.

9. The projector of claim 8, wherein the power supply further comprises:

a rectifier transforming an alternating current to a direct current;

a power-factor corrector correcting a power factor of the alternating current;

a DC voltage converter adjusting a voltage from the power-factor corrector to an optimum voltage for the LED driver, wherein the optimum voltage is the sum of the operating voltage of the LED and the voltage drop for operating the LED driver; and a digital-to-analog converter electrically connected to the DC voltage converter and the processor, converting a control signal sent by the processor to a control voltage, and sending the control voltage to the DC voltage converter to adjust the supply voltage.

10. The projector of claim 8, wherein the LED driver further comprises:

a voltage-to-current converter electrically connected to the power supply, and converting the supply voltage to the driving current; and a driving control circuit electrically connected to the processor and the voltage-to-current converter, obtaining the operating voltage of the LED, sending the driving signal to the processor, and managing the driving current to the LED by getting a command from the processor.

11. A system for controlling an electric power of a light emission diode (LED), comprising:

a power supply providing a supply voltage;

a processor sending a first command, and adjusting the supply voltage; and an LED driver electrically connected to the processor, outputting a driving current to the LED in response to the first command from the processor, and comprising:

a voltage-to-current converter electrically connected to the power supply, and converting the supply voltage to the driving current; and a driving control circuit electrically connected to the processor and the voltage-to-current converter, obtaining an operating voltage of the LED, sending a driving signal associated with the operating voltage to the processor, and managing the driving current to the LED by getting a second command from the processor.

12. The system of claim 11, wherein:

the LED driver is electrically connected to the power supply and receives the supply voltage;

the processor is electrically connected to the power supply, obtains the driving signal from the LED driver and controls the power supply to adjust the supply voltage; and the LED is a light source of a projector including the system and the LED.

13. The system of claim 12, wherein the driving signal includes information of the operating voltage of the LED.

14. The system of claim 13, wherein the processor sends a control signal to the power supply for controlling the power supply to adjust the supply voltage.

15. The system of claim 14, wherein the control signal includes information of a required adjustment to the supply voltage provided by the power supply.

16. The system of claim 14, wherein the power supply further comprises:

a rectifier transforming an alternating current to a direct current; and a power-factor corrector correcting a power factor of the alternating current.

17. The system of claim 16, wherein the power supply further comprises:

a DC voltage converter adjusting a voltage from the power-factor corrector to an optimum voltage for the LED driver, wherein the optimum voltage is a sum of the operating voltage of the LED and a voltage drop for operating the LED driver; and a digital-to-analog converter electrically connected to the DC voltage converter, converting the control signal to a control voltage, and sending the control-voltage to the DC voltage converter to adjust the supply voltage.

* * * * *